US006250595B1

(12) United States Patent
Campbell

(10) Patent No.: US 6,250,595 B1
(45) Date of Patent: Jun. 26, 2001

(54) PAINT BUCKET HOLDER

(76) Inventor: Francis Campbell, 1025 S. Terry, Longmont, CO (US) 80501

( * ) Notice: Subject to any disclaimer, the term of this patent is extended or adjusted under 35 U.S.C. 154(b) by 0 days.

(21) Appl. No.: 09/428,699

(22) Filed: Oct. 27, 1999

(51) Int. Cl.[7] ..... E06C 7/14

(52) U.S. Cl. ..... 248/211; 182/129; 248/304; 248/339

(58) Field of Search ..... 248/210, 211, 248/214, 238, 303, 304, 339, 447, 243; 182/129

(56) References Cited

U.S. PATENT DOCUMENTS 1,795,059 * 3/1931 Vance et al. ..... 248/304
1,798,768 * 3/1931 Vance ..... 248/304
4,433,822 * 2/1984 Caggiano ..... 248/210
5,062,607 * 11/1991 Kisner ..... 248/211
5,687,941 * 11/1997 Quintile ..... 248/211 X
5,797,571 * 8/1998 Brophy ..... 248/210

* cited by examiner

*Primary Examiner*—Ramon O. Ramirez
(74) *Attorney, Agent, or Firm*—John D. Gugliotta; Michael J. Corrigan

(57) ABSTRACT

The invention is a canister support device for a ladder. Specifically, it is designed to hold a paint can on the ladder providing access to the paint while standing on the ladder. The support is made of heavy aluminum or stainless steel and comprises two rung-engaging hooks and a hook for the paint can. The rung-engaging hooks are adjustable for any size rung.

2 Claims, 2 Drawing Sheets

FIG. 3
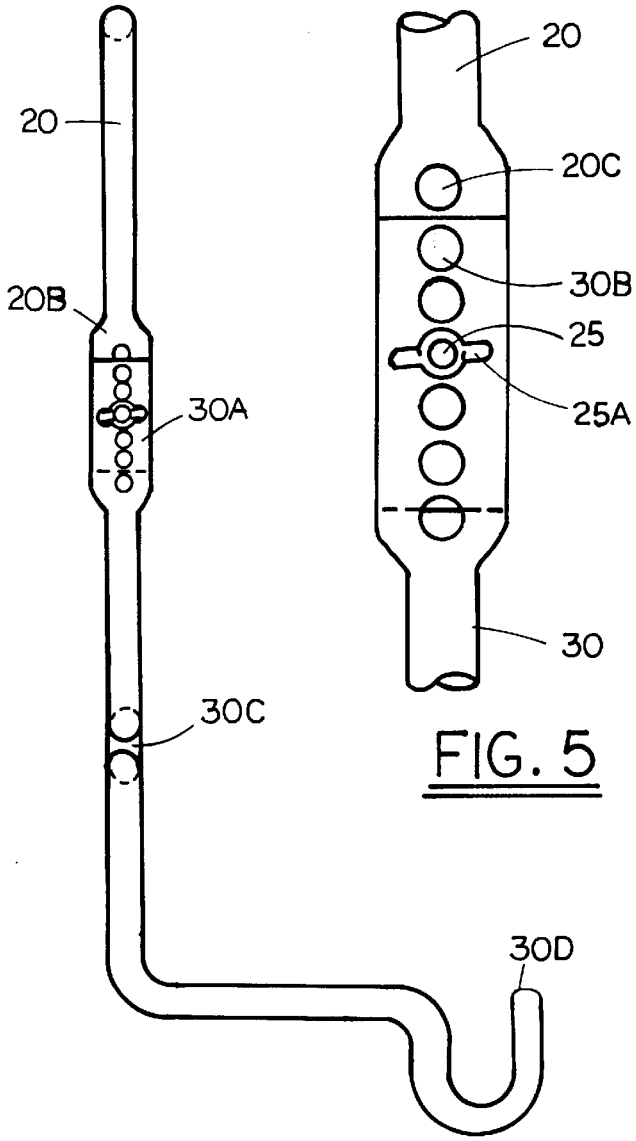
FIG. 5
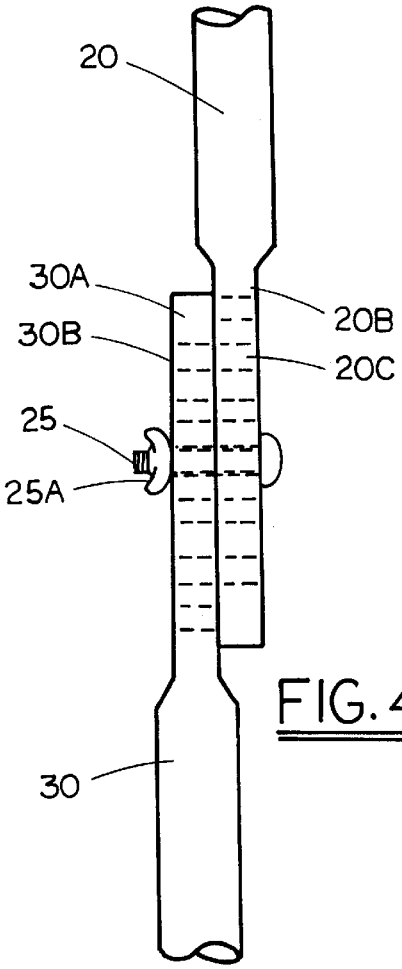
FIG. 4

PAINT BUCKET HOLDER

RELATED APPLICATIONS

The present invention was first described in Disclosure Document Number 457931 filed on Jun. 18, 1999. There are no previously filed, nor currently any co-pending applications, anywhere in the world.

BACKGROUND OF THE INVENTION

1. Field of the Invention

The present invention relates generally to painting equipment and, more particularly, to a holder for securely holding a paint bucket on a ladder.

2. Description of the Related Art

Painting the exterior of a house quite often proves to be a messy process. It doesn't matter if you are having it done professionally, or are doing it yourself. Paint will still get spilled on the ground, on landscape and vegetation, and on surfaces that are not supposed to get painted. One of the biggest causes of this paint spillage comes from painting that is done while the painter is on an extension ladder. Often the painter is forced to hold the bucket in one hand while painting with the other. This does not leave one hand free to hold the ladder, which obviously is a safety hazard. A solution to this problem that many people have used is the formation of a simple "S" hook, fashioned from heavy wire, that connects to a rung of the ladder and provides a place from which to hang the paint bucket. This however, leads to the bucket swaying, especially when the brush is dipped into the paint, that may also lead to spilled paint. Accordingly, there is a need for a means by which a paint bucket may be suspended from an extension ladder while painting, that does not exhibit the tendency to sway as found with conventional paint bucket hooks. The development of the present invention fulfills this need.

In the related art, there exists many patents for devices for holding a bucket of paint in the rung area of a ladder. None of them disclose the no-sway paint bucket hook adjustable for ladders of varying rung heights with a sidewardly extending paint bucket hook as devised A search of the prior art did not disclose any patents that read directly on the claims of the instant invention; however, the following references were considered related:

| U.S. Pat. No. | Inventor | Issue Date |
|---|---|---|
| 5,584,453 | Morter | Dec. 17, 1996 |
| 4,580,752 | Patrick | April 8, 1986 |
| 4,433,822 | Caggiano | Feb. 28, 1984 |
| 4,658,455 | Skillern | Apr. 21, 1987 |
| 2,735,641 | Joecks | Feb. 21, 1956 |
| 5,226,623 | Hunt et al. | Jul. 13, 1993 |
| 5,154,383 | Collinson | Oct. 13, 1992 |
| 5,062,607 | Kisner | Nov. 5, 1991 |
| 2,522,658 | Williams | Aug. 16, 1949 |
| D 313,742 | Ruff | Jan. 15, 1991 |
| D 311,327 | Hughes | Oct. 16, 1990 |

SUMMARY OF THE INVENTION

It is therefore an object of the present invention to provide a paint bucket hanging device.

It is therefore another object of the present invention to provide a paint hook which will not sway like common "S" hooks.

It is yet another object of the present invention to make painting jobs go faster and easier.

It is yet still another object of the present invention to reduce or eliminate spilled paint.

It is still yet another object of the present invention to provide a painting aid so that a painter has one hand free to hold ladder for increased safety.

It is another object of the present invention to provide an interior lip that prevents a paint bucket from becoming accidentally dislodged.

It is a feature of the present invention to that it will not fall off the ladder while being moved or transported.

It is another feature of the present invention to hold all types of paint buckets with handles.

It is yet another feature of the present invention to easily fit any size or style of ladder.

It is yet still another feature of the present invention to provide a holder which clamps over adjacent rungs on an extension ladder.

It is another feature of the present invention to provide a holder which is easily moved from rung to rung.

It is yet another feature of the present invention that it can be used on multiple ladders.

Briefly described according to one embodiment of the present invention, The No-Sway Bucket Holder, as its name implies, is an apparatus to aid in the holding of a bucket of paint while on an extension ladder. The invention comprises three hooks connected together with bolts and wing nuts. Two hooks are for the purposes of connecting to two sequential ladder rungs on an extension ladder. A slotted arrangement in the hook structure allows for adjustment to different sizes and types of ladders. The third hook, is provided for the handle of the paint bucket and has a small inside lip to prevent its accidental dislodgement. The hook will hang on the inside of the ladder, toward the structure to be painted, and allows for ease of reach by the painter without getting in the way. The use of The No-Sway Bucket Holder allows painters the ability to quickly paint houses or other structures while on an extension ladder without requiring the painter to balance the can of paint or hang it from a simple A "S" hook which may sway back and forth causing the spilling of paint.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 3 is a front side view of a Paint Bucket Hook, according to the preferred embodiment of the present invention;

FIG. 4 is a enlarged partial cutaway right side view of the connecting portions of a Paint Buck Hook installed on a conventional ladder, according to the preferred embodiment of the present invention; and FIG. 5 is a enlarged partial cutaway front side view of the connecting portions of a Paint Bucket Hook installed on a conventional ladder, according to the preferred embodiment of the present invention; FIG. 5 is a front view of a Paint Bucket Hook, according to the preferred embodiment of the present invention.

LIST OF REFERENCE NUMBERS

| | |
|---|---|
| 10 | Paint Bucket Hook |
| 20 | Upper Loop |
| 20a | Rung Hook |
| 20b | First Tongue |
| 20c | Aperture |
| 25 | Bolt |
| 25a | Wing Nut |
| 30 | Bottom Hook |
| 30a | Second Tongue |
| 30b | Aperture |
| 30c | Rung Fork |
| 30d | Paint Hook |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
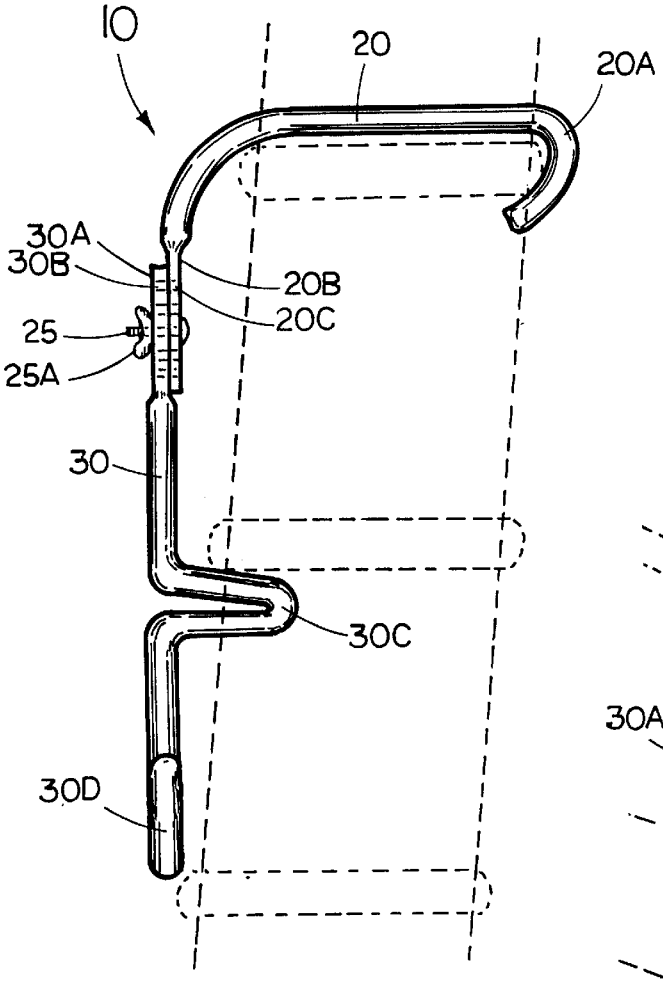
FIG. 1 is a right side view of a Paint Bucket Hook installed on a conventional ladder, according to the preferred embodiment of the present invention.

Referring now to FIG. 1, a Paint Bucket Hook 10 is shown, according to the present invention, for securely supporting a conventional one gallon paint bucket from the rungs of a conventional ladder 5. For purposes of disclosure a model designed for installation on the right side of a ladder is shown but a left handed model could equally as well be made. Paint Bucket Hook 10 is comprised of two pieces of stiff metal rod bent and formed as shown. The first piece, Upper Loop 20 is comprised of an rung hook 20*a* bent to grab an upper rung of a ladder. Upper loop 20 is bent so that the other end is pointing downward ninety degrees from the plane of the ladder rung. Located at that end of upper loop 20 is first tongue 20*b* formed by flattening that end of upper loop 20. A plurality of apertures 20*c* are formed in tongue 20*b* for receiving a bolt 25. A similar second tongue 30*a* is mated next to first tongue 20*b* formed on the upper end of a bottom hook 30. Second tongue 30*a* is formed exactly like first tongue 20*b*. A plurality of apertures 30*b* receive bolt 25 like first tongue 20*b*. A wing nut 25*b* is securely wrenched onto bolt 25 securely binding first tongue 20*b* and second tongue 30*a*. About midway down bottom hook 30 is a rung fork 30 for engaging the bottom surface of a ladder rung directly beneath the ladder rung upper loop 20 is wrapped around. Rung fork 30*c* is simply a portion of bottom hook 30 bent ninety degrees once, then bent one hundred eighty degrees, and finally, bent ninety degrees once more to form a rearwardly extending fork. Rung fork 30*c* engages the rung is a semi-interference type fit keeping Paint Bucket Hook 10 from swaying back and forth. By loosening wing nuts 25*a* and removing bolt 25, first tongue 20*b* and second tongue 30*a* can be adjusted relative to each other for adjusting the distance between rung fork 30*c* and rung hook 20*a* for ladders with varying distances between rungs. One simply lines up the corresponding apertures in first tongue 20*b* and second tongue 30*a* and inserts bolt 25 and secures it with wing nut 25*a*.

Figure 2:
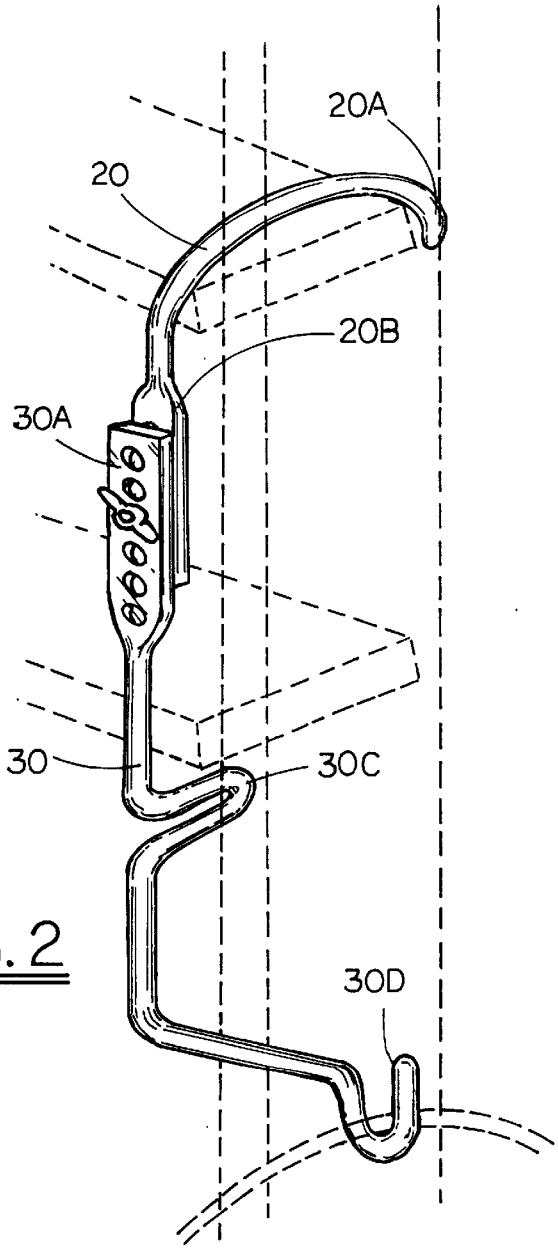
FIG. 2 is a perspective view of a Paint Bucket Hook installed on a conventional ladder, according to the preferred embodiment of the present invention.

Located at the lower end of bottom hook 30 is a paint hook 30*d* formed by bending the rod material into a loop. Paint hook 30 is also bent so that it is sidewardly facing to the side of ladder 5 to keep a paint bucket away from the rung area of the ladder but in reach of the person on the ladder as in FIG. 2. With rung hook 20*a* grabbing the rung of a ladder and rung fork 30*c* engaging the bottom of the next lower rung, Paint Bucket Hook 10 is securely and removably attached to ladder 5.

FIGS. 4 and 5 show more detail of the adjustable coupling of upper loop 20 to bottom hook 30 via the plurality of aperture arrangement in first tongue 20*b* and second tongue 30*a* as heretofore described.

2. Operation of the Preferred Embodiment

In operation, the rung hook of the present invention is looped around an upper rung of a ladder one desires to paint on. A rung fork located lower on the device is designed to engage the lower surface of the next lower rung to securely hold the device on the ladder and keep it from swaying. A pair of wing nuts allows the device to be adjusted for ladders with varying distances between successive rungs. A conventional bucket of paint with a loop handle may now be hung from a sidewardly extending hook located on the bottom of the device. To remove, one simply pulls the rung fork off of the lower rung and unhooks the rung hook from the upper rung.

The foregoing description is included to illustrate the operation of the preferred embodiment and is not meant to limit the scope of the invention. The scope of the invention is to be limited only by the following claims.

What is claimed is:

1. A paint bucket hook, for securely supporting a conventional one gallon paint bucket from the rungs of a conventional ladder, said paint bucket hook comprising:

an upper loop forming a rung hook, said upper loop formed having an upper hook and a bottom hook, said upper hook formed to grab an upper rung of a ladder, said bottom hook formed to be pointing downward ninety degrees from the plane of the ladder rung;

a first tongue located at said upper hook of said upper loop and formed by flattening said upper hook of said upper loop;

a second tongue, said second tongue mated next to said first tongue and formed on said bottom hook;

a plurality of apertures are formed by said first tongue and said second tongue respectively, each for receiving a bolt;

a bold and nut fastener for securely binding said first tongue to said second tongue;

a rung fork, said rung fork located midway between said upper hook and said bottom hook, said rung fork for engaging the bottom surface of a ladder rung directly beneath the ladder rung upper loop.

2. The paint bucket hook of claim 1, wherein said paint bucket hook is additionally formed such that it is sidewardly facing to the side of ladder, thereby keeping a paint bucket away from the rung area of the ladder but in reach of the person on the ladder.

* * * * *